US010605217B2

(12) United States Patent
Namuduri et al.

(10) Patent No.: US 10,605,217 B2
(45) Date of Patent: Mar. 31, 2020

(54) VEHICLE ENGINE STARTER CONTROL SYSTEMS AND METHODS

(71) Applicant: GM GLOBAL TECHNOLOGY OPERATIONS LLC, Detroit, MI (US)

(72) Inventors: Chandra S. Namuduri, Troy, MI (US); Lei Hao, Troy, MI (US); Thomas W. Nehl, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 105 days.

(21) Appl. No.: 15/452,312

(22) Filed: Mar. 7, 2017

(65) Prior Publication Data

US 2018/0258900 A1 Sep. 13, 2018

(51) Int. Cl.

| | |
|---|---|
| ***F02N 11/08*** | (2006.01) |
| ***F02N 15/06*** | (2006.01) |
| ***F02N 15/02*** | (2006.01) |

(52) U.S. Cl.

CPC ..... *F02N 11/0848* (2013.01); *F02N 11/08* (2013.01); *F02N 15/023* (2013.01); *F02N 15/067* (2013.01); *F02N 11/0862* (2013.01); *F02N 2011/0896* (2013.01); *F02N 2200/041* (2013.01); *F02N 2200/044* (2013.01); *F02N 2200/047* (2013.01); *F02N 2300/108* (2013.01)

(58) Field of Classification Search

CPC .... F02N 11/0848; F02N 11/08; F02N 15/023; F02N 15/067; F02N 11/0862; F02N 2011/0896; F02N 2200/041; F02N 2200/044; F02N 2200/047; F02N 2300/108

USPC ..... 123/179.3, 179.25, 185.1, 185.5, 185.6

See application file for complete search history.

(56) References Cited

U.S. PATENT DOCUMENTS 4,459,968 A * 7/1984 Brandt ..... F02P 1/04 123/617

5,151,017 A 9/1992 Sears et al.

(Continued)

FOREIGN PATENT DOCUMENTS

CN 2711983 Y 7/2005

CN 1303430 C 3/2007

(Continued)

OTHER PUBLICATIONS

Lei Hao et al., Utility U.S. Appl. No. 15/961,176, filed Apr. 24, 2018.

(Continued)

*Primary Examiner* — Phutthiwat Wongwian
*Assistant Examiner* — Susan E Scharpf
(74) *Attorney, Agent, or Firm* — Quinn IP Law

(57) ABSTRACT

A vehicle propulsion system includes an engine configured to be selectively activated to provide torque to propel the vehicle and a starter module coupled to the engine and configured to start the engine from an inactive state. The starter module includes a brushless electric machine to generate an output torque to crank start the engine. The starter motor also includes a pinion gear coupled to the electric machine, where the pinion gear is actuatable to selectively engage a cranking input of the engine. A controller assembly is programmed to cause actuation of the pinion gear to engage the cranking input of the engine and transfer a cranking torque to activate the engine.

14 Claims, 7 Drawing Sheets

(56) References Cited

U.S. PATENT DOCUMENTS 5,332,965 A * 7/1994 Wolf ..... G01D 3/02 324/202
5,927,240 A * 7/1999 Maxon ..... B60R 25/04 123/179.25
6,034,459 A 3/2000 Matsunobu et al.
6,104,185 A * 8/2000 Lamm ..... G01P 3/487 324/207.12
6,202,776 B1 * 3/2001 Masberg ..... F02B 67/04 180/65.22
6,244,296 B1 * 6/2001 Lafler ..... F16K 37/0033 137/554
6,512,366 B2 * 1/2003 Siess ..... G01D 5/145 324/207.13
6,556,005 B1 * 4/2003 Oomkes ..... G01D 5/145 324/207.2
7,105,971 B2 9/2006 Asai et al.
7,116,065 B2 10/2006 Wakitani et al.
7,339,370 B2 * 3/2008 Reimer ..... G01D 5/2452 324/207.21
7,436,139 B2 10/2008 Maslov et al.
7,482,724 B2 1/2009 Fujiwara et al.
7,657,350 B2 2/2010 Moran
7,657,351 B2 2/2010 Moran
7,680,568 B2 3/2010 Moran
7,689,330 B2 3/2010 Moran
7,689,331 B2 3/2010 Moran
7,740,092 B2 6/2010 Bender
7,806,095 B2 10/2010 Cook et al.
8,134,343 B2 3/2012 Like et al.
8,408,341 B2 4/2013 Dalum et al.
8,427,139 B2 * 4/2013 Malik ..... G01D 5/145 324/207.2
8,541,919 B2 9/2013 Lokhandwalla et al.
8,544,575 B1 * 10/2013 Scaringe ..... B60K 6/485 180/65.21
8,761,981 B2 6/2014 Hussain et al.
8,905,166 B2 12/2014 Dalum et al.
8,978,798 B2 3/2015 Dalum et al.
8,996,227 B2 3/2015 Sisk et al.
9,121,380 B2 * 9/2015 Fulton ..... F02N 11/02
9,174,525 B2 11/2015 Caron
9,370,992 B2 6/2016 Holmes et al.
9,475,481 B2 10/2016 Holmes et al.
9,567,922 B2 2/2017 Lofgren
9,586,575 B2 3/2017 Holmes et al.
9,597,979 B1 3/2017 Hao et al.
9,816,475 B1 11/2017 Buchanan
9,878,607 B2 1/2018 Caron
10,124,793 B2 11/2018 Ciaccio et al.
10,184,442 B2 1/2019 Hao et al.
2001/0039230 A1 11/2001 Severinsky et al.
2002/0153796 A1 10/2002 Yoshinaga et al.
2003/0048024 A1 3/2003 Chu
2003/0183430 A1 10/2003 Naito et al.
2003/0189375 A1 * 10/2003 Raad ..... B60L 7/00 303/20
2005/0099155 A1 5/2005 Okuda et al.
2005/0140235 A1 6/2005 Yamagishi et al.
2005/0236246 A1 10/2005 Joki
2006/0116797 A1 6/2006 Moran
2007/0007057 A1 1/2007 Fujino et al.
2007/0018522 A1 1/2007 Ackva et al.
2007/0068714 A1 3/2007 Bender
2007/0124037 A1 5/2007 Moran
2007/0213151 A1 9/2007 Usoro
2007/0227470 A1 * 10/2007 Cole ..... H02K 1/2786 123/3
2008/0012445 A1 1/2008 Abe et al.
2008/0079389 A1 4/2008 Howell et al.
2008/0097661 A1 4/2008 Moran
2008/0147260 A1 6/2008 Moran
2008/0177434 A1 7/2008 Moran
2008/0193275 A1 8/2008 De Filippis et al.
2008/0203846 A1 8/2008 Hoemann et al.
2008/0265586 A1 10/2008 Like et al.
2009/0024265 A1 1/2009 Kortschak et al.
2009/0085418 A1 * 4/2009 Kobayashi ..... H02K 3/522 310/66
2009/0107443 A1 * 4/2009 Sarbacker ..... F02N 11/0862 123/179.28
2009/0179518 A1 7/2009 Tajima et al.
2009/0206660 A1 8/2009 Makita et al.
2010/0001523 A1 1/2010 Sato et al.
2010/0145562 A1 6/2010 Moran
2010/0236851 A1 9/2010 Van Maanen et al.
2010/0300646 A1 12/2010 Sawaguchi et al.
2011/0009235 A1 1/2011 Song et al.
2011/0083919 A1 4/2011 Kshatriya
2011/0125353 A1 * 5/2011 Komeda ..... B60K 6/387 701/22
2011/0267851 A1 11/2011 Nagel et al.
2012/0025601 A1 2/2012 Nefcy et al.
2012/0053011 A1 * 3/2012 Onomura ..... B60K 6/383 477/3
2012/0126614 A1 * 5/2012 Inoue ..... B60R 16/033 307/10.1
2012/0206109 A1 8/2012 Fassnacht et al.
2012/0247846 A1 * 10/2012 Ichikawa ..... B60H 1/00207 180/65.21
2013/0038271 A1 2/2013 Park
2013/0046435 A1 * 2/2013 Shin ..... F02N 11/08 701/32.8
2013/0106219 A1 5/2013 Schneider et al.
2013/0138328 A1 5/2013 Shimo et al.
2013/0154397 A1 6/2013 Sullivan
2013/0300371 A1 11/2013 Bills
2013/0320764 A1 12/2013 Zeller
2014/0015364 A1 1/2014 Iwatsu et al.
2014/0067183 A1 3/2014 Sisk
2014/0091664 A1 4/2014 Aoyama
2014/0244082 A1 8/2014 Caron
2014/0260792 A1 * 9/2014 Bradfield ..... F02N 11/0855 74/7 A
2014/0292073 A1 10/2014 Zhang et al.
2014/0319957 A1 10/2014 Hao et al.
2015/0051821 A1 * 2/2015 Presot ..... F02N 11/0855 701/113
2015/0105949 A1 4/2015 Wright et al.
2015/0112536 A1 * 4/2015 Severinsky ..... B60H 1/004 701/22
2015/0211469 A1 * 7/2015 Ghoneim ..... F02N 11/0825 701/113
2015/0224845 A1 8/2015 Anderson et al.
2015/0239334 A1 8/2015 El Baraka et al.
2015/0258881 A1 9/2015 Holmes et al.
2015/0258946 A1 * 9/2015 Namuduri ..... B60K 6/40 307/10.1
2015/0283964 A1 10/2015 Janarthanam
2015/0295459 A1 10/2015 Hao et al.
2015/0303750 A1 10/2015 Bouarroudj et al.
2015/0336573 A1 11/2015 Swales et al.
2015/0361941 A1 * 12/2015 Du ..... F02N 11/108 702/33
2016/0006311 A1 * 1/2016 Li ..... H02K 3/28 310/68 B
2016/0032880 A1 2/2016 Lovett et al.
2016/0046281 A1 2/2016 Nedorezov et al.
2016/0052383 A1 2/2016 Caron
2016/0056684 A1 2/2016 Nemoto et al.
2016/0257190 A1 9/2016 Holmes et al.
2016/0290304 A1 10/2016 Yukawa et al.
2016/0327007 A1 11/2016 Averbukh et al.
2017/0008469 A1 1/2017 Holmes et al.
2017/0082012 A1 3/2017 Jang
2017/0152828 A1 * 6/2017 Bradfield ..... F02N 11/0851
2017/0234285 A1 8/2017 Huh et al.
2017/0253231 A1 9/2017 Ciaccio et al.
2017/0327106 A1 11/2017 Johri et al.
2017/0328329 A1 11/2017 Buchanan
2017/0334297 A1 11/2017 Hao et al.
2017/0334422 A1 11/2017 Namuduri et al.
2017/0338706 A1 11/2017 Hao et al.

(56) References Cited

U.S. PATENT DOCUMENTS

| | | | |
|---|---|---|---|
| 2018/0030944 | A1 | 2/2018 | Raad |
| 2018/0030945 | A1 | 2/2018 | Caballero Atienzar |
| 2018/0219377 | A1 | 8/2018 | Laval et al. |
| 2018/0219381 | A1 | 8/2018 | Laval et al. |
| 2018/0298862 | A1 | 10/2018 | Choi et al. |
| 2018/0347534 | A1 | 12/2018 | Lebreux et al. |
| 2018/0372200 | A1 | 12/2018 | Kumar et al. |
| 2019/0077393 | A1 | 3/2019 | Ciaccio et al. |
| 2019/0153988 | A1 | 5/2019 | Lebreux et al. |
| 2019/0153989 | A1 | 5/2019 | Lebreux et al. |
| 2019/0153990 | A1 | 5/2019 | Lebreux et al. |

FOREIGN PATENT DOCUMENTS

| | | | |
|---|---|---|---|
| CN | 101487434 | A | 7/2009 |
| CN | 102025248 | A | 4/2011 |
| CN | 102923124 | A | 2/2013 |
| CN | 105849404 | A | 8/2016 |
| DE | 102008040830 | A1 | 2/2010 |
| DE | 102011056431 | A1 | 6/2013 |
| EP | 0619427 | B1 | 10/1994 |
| JP | 2000104650 | A | 4/2000 |
| JP | 2003148317 | A | 5/2003 |
| JP | 2005-080381 | A | 7/2005 |

OTHER PUBLICATIONS

Quanbao Zhou, John Houldcroft, "Cold engine cranking torque requirement analysis," SAE International Inc., 2007, JSAE 20077002.
Hao et al., Utility U.S. Appl. No. 15/811,740, filed Nov. 14, 2017.
Hao et al., Utility U.S. Appl. No. 15/158,887, filed May 19, 2016.
Hao et al., Utility U.S. Appl. No. 15/417,734, filed Jan. 27, 2017.
Bilal Akin and Manish Bhardwaj, "Trapezoidal Control of BLDC Motors Using Hall Effect Sensors", Texas Instruments, Jul. 2013; 35 pages.
Ayman M. El-Refaie, "Fractional-Slot Concentrated-Windings Synchronous Permanent Magnet Machines: Opportunities and Challenges", IEEE Transactions on Industrial Electronics, vol. 57, No. 1, Jan. 2010; pp. 107-121.
J. S. Lawler et al., "Limitations of the Conventional Phase Advance Method for Constant Power Operation of the Brushless DC Motor", U.S. Department of Energy, 11 pages.
Namuduri et al., Utility U.S. Appl. No. 15/961,198, filed Apr. 24, 2018.
Namuduri et al., Utility U.S. Appl. No. 15/961,204, filed Apr. 24, 2018.

* cited by examiner

VEHICLE ENGINE STARTER CONTROL SYSTEMS AND METHODS

TECHNICAL FIELD

The present disclosure relates to vehicle propulsion system engine starters and control methods.

INTRODUCTION

Combustion engines may have an electric starter coupled to the engine to turn a crankshaft leading up to a start event. The electric starter can be an electric motor having contact brushes to conduct current between stationary wires on a stator portion and moving parts of a rotor portion. The physical contacts may wear over time leading to motor degradation. Additionally, a brushed motor delivers substantially zero torque near the upper bound of its available speed range.

SUMMARY

A vehicle propulsion system includes an engine configured to be selectively activated to provide torque to propel the vehicle and a starter module coupled to the engine and configured to start the engine from an inactive state. The starter module includes a brushless electric machine to generate an output torque to crank start the engine. The starter motor also includes a pinion gear coupled to the electric machine, where the pinion gear is actuatable to selectively engage a cranking input of the engine. A controller assembly is programmed to cause actuation of the pinion gear to engage the cranking input of the engine and transfer a cranking torque to activate the engine.

An engine starter electric machine includes a stator having a plurality of windings in electrical connection to a power supply and a rotor disposed in a center bore portion of the stator. The rotor includes a plurality of permanent magnets that are driven to rotate in response to power supplied to the plurality of windings of the stator. The engine starter electric machine includes an output shaft extending from a center portion of the rotor, where the output shaft is selectively coupled to an engine cranking input. The engine starter electric machine also includes a controller assembly storing instructions to pass current from the power supply to the plurality of windings as multi-phase alternating current to drive the rotor.

A vehicle propulsion system includes an engine configured to be selectively activated to generate torque to propel the vehicle and a brushless electric machine having a pinion selectively coupled to a cranking input of the engine. The brushless electric machine is configured to start the engine from an inactive state. The vehicle propulsion system also includes a controller having a power inverter to convert direct current from a power supply into multi-phase alternating current to drive the electric machine. The controller is programmed to receive an engine start command from a vehicle controller. The controller is also programmed to operate a plurality of switches in connection with the power supply using pulse width modulation (PWM) to generate the multi-phase alternating current in response to an engine start command. The controller is further programmed to adjust the operation of the plurality of switches based on at least one of a rotor position feedback signal and a current draw feedback signal from the electric machine.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
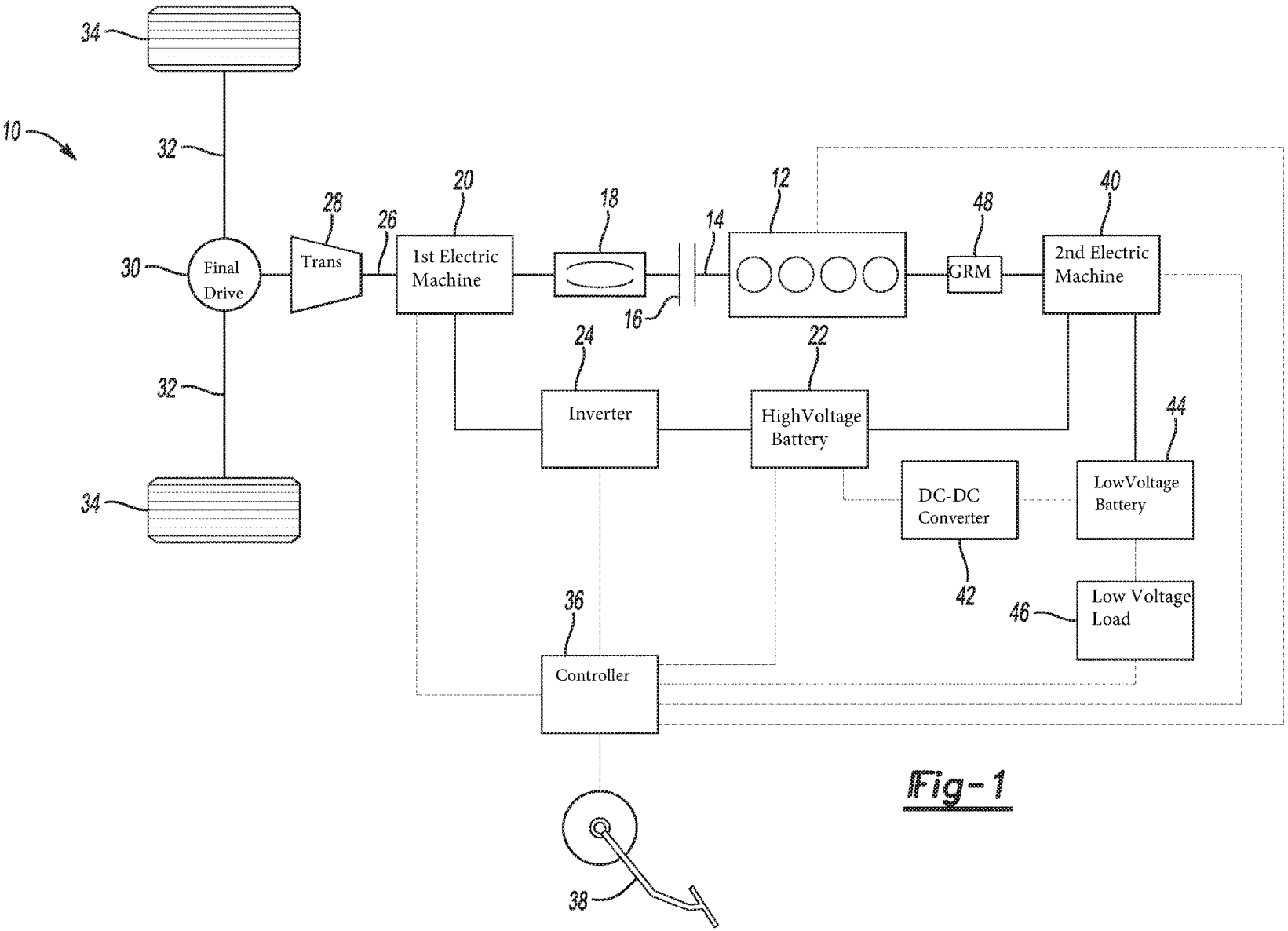
FIG. 1 is a system schematic of a vehicle propulsion system.

Referring to FIG. 1, a vehicle 10 is provided. By way of example, vehicle 10 is a hybrid electric vehicle (HEV) having a powertrain with both a petrol propulsion source and an electric propulsion source. Either or both of the propulsion sources may be selectively activated to provide propulsion based on the vehicle operating conditions. Internal combustion engine 12 operates as a petrol propulsion source and outputs torque to a shaft 14. The engine 12 may have a plurality of cylinders to generate power from the combustion of a fuel to cause rotation of the shaft 14. One or more decoupling mechanisms may be included along shaft 14 in order to decouple output of engine 12 from the remaining portions of the powertrain. A clutch 16 is provided to allow selection of a partial or complete torque decoupling of the engine 12. In one example clutch 16 is a friction clutch having a plurality of friction plates which are at least partially engaged when the clutch is closed to transfer torque, and disengaged when the clutch is opened to isolate torque flow between the downstream portions of the powertrain and the engine 12.

A torque converter 18 may also be included to provide a fluid coupling between the output portion of engine 12 and downstream portions of the driveline. The torque converter 18 operates to smoothly ramp up torque transfer passed from the engine to the driveline. Also, the torque converter allows a decoupling such that the engine may continue to operate at low rotational speed without causing propulsion of the vehicle (e.g., such as stationary idle conditions).

A first electric machine 20 operates as the electric propulsion source and is powered by a high-voltage traction battery 22. Generally, a high-voltage battery is one that has an operating voltage greater than about 30 volts up to about 60 volts. In one example, the traction battery 22 is a lithium ion high-voltage battery with a nominal voltage of 48 volts. High-voltage direct current is conditioned by an inverter 24 before delivery to the first electric machine 20. The inverter 24 includes a number of switches and a control circuit which operate to convert the direct current into three-phase alternating current to drive the electric machine.

The first electric machine 20 has multiple operating modes depending on the direction of power flow. In a motor mode, power delivered from the high-voltage battery 22 allows the motor to output torque to shaft 26. The output torque may then be transferred through a variable ratio transmission 28 to change the gear ratio prior to delivery to a final drive mechanism 30. In one example the final drive mechanism 30 is a differential configured to distribute torque to one or more side shafts 32 which are coupled to wheels 34. The first electric machine 20 may be disposed either upstream of the transmission 28, downstream of the transmission 28, or integrated within a housing of the transmission 28.

The first electric machine 20 is also configured to operate in a generation mode to convert rotational motion into power to be stored at high-voltage battery 22. When the vehicle is moving, whether propelled by the engine or coasting from its own inertia, rotation of shaft 26 turns an armature, or rotor, (not shown) of the first electric machine 20. The motion causes an electromagnetic field to generate alternating current that is passed through the inverter 24 for conversion into direct current. The direct current may then be provided to the high-voltage battery 22 to replenish the charge stored at the battery. A unidirectional or bidirectional DC-DC converter 42 is used to charge a low-voltage (e.g., 12 volt) battery 44 and supply the low voltage loads 46 such as the conventional 12 volt loads. When a bidirectional DC-DC converter 42 is used, it is possible to jump start the high-voltage battery 22 from the low-voltage battery.

The various propulsion system components discussed herein may have one or more associated controllers to control and monitor operation. Controller 36, although schematically depicted as a single controller, may be implemented as one controller, or as system of controllers in cooperation to collectively manage the propulsion system. Multiple controllers may be in communication via a serial bus (e.g., Controller Area Network (CAN)) or via discrete conductors. The controller 36 includes one or more digital computers each having a microprocessor or central processing unit (CPU), read only memory (ROM), random access memory (RAM), electrically-programmable read only memory (EPROM), a high speed clock, analog-to-digital (A/D) and digital-to-analog (D/A) circuitry, input/output circuitry and devices (I/O), as well as appropriate signal conditioning and buffering circuitry. The controller 36 may also store a number of algorithms or computer executable instructions needed to issue commands to perform actions according to the present disclosure.

The controller 36 is programmed to monitor and coordinate operation of the various propulsion system components. The controller 36 is in communication with the engine 12 and receives signals indicative of at least engine speed, temperature, as well as other engine operating conditions. The controller 36 is also in communication with the first electric machine 20 and receives signals indicative of motor speed, torque, and current draw. The controller may also be in communication with battery 22 and receive signals indicative of at least battery state of charge (SOC), temperature, and current draw. The control also receives signals indicative of the circuit voltage across the high-voltage bus. The controller 36 may further be in communication with one or more sensors at a driver input pedals 38 to receive signals indicative of pedal position which may reflect acceleration demand of the driver. The driver input pedal 38 may include an accelerator pedal and/or a brake pedal. In alternative embodiments such as a self-driving autonomous vehicle, acceleration demand may be determined by a computer either on-board or off-board of the vehicle without driver interaction.

As mentioned above, either one or both of the engine 12 and the first electric machine 20 may be operated at a particular time based at least on the propulsion requirements of the vehicle. During high torque demand conditions, the controller 36 may cause both of the engine 12 and the first electric machine 20 to be activated such that each provides an output torque which in combination propel the vehicle 10.

In certain moderate torque required conditions, the engine operates efficiently and may be used as the sole propulsion source. For example, during highway driving with a generally constant speed, the first electric machine 20 may be deactivated such that only the engine 12 provides output torque.

Under other example operating conditions, the engine 12 may be deactivated such that only the electric machine 20 provides output torque. The clutch 16 may be opened to decouple the shaft 14 from the downstream portions of the powertrain. Specifically, during vehicle coast conditions where a driver allows the vehicle to decelerate under its own resistance, the engine may be deactivated and the motor operated in generator mode to recover energy. Additionally, engine deactivation may be desirable during a temporary vehicle standstill such as at a traffic light. Instead of allowing the engine to idle, fuel consumption may be reduced by deactivating the engine while the vehicle is stationary. In both examples, it may be beneficial to rapidly restart the engine from an inactive state in response to a subsequent increase in propulsion demand. A prompt engine startup may avoid roughness and/or latency in power delivery being perceived by a driver.

Vehicle 10 includes a second electric machine 40 that is selectively coupled to the engine 12. The second electric machine 40 operates as a starter motor and when engaged with the engine leading up to a combustion cycle, and provides input torque to a cranking input portion of the engine to facilitate a cold start or a restart. The second electric machine 40 may be connected to a flywheel portion of the engine through a geared mechanical connection to pass torque to the crankshaft to start the engine. In another example, the second electric machine 40 may be connected to a crank pulley via a toothed belt mechanical connection to pass torque to the crankshaft of the engine. The controller 36 is programmed to issue a command to start the engine 12 using the second electric machine 40 in response to an acceleration demand following a period of reduced acceleration demand.

Discussed in more detail below, the second electric machine 40 is selectively engageable to the engine through a sliding pinion gear in connection with a motor output shaft. A solenoid may be disposed to actuate the pinion gear from a first disengaged position to a second position that is in mechanical connection with the engine crankshaft to transfer torque. There are also different configurations of intermediate components, such as a gear reduction mechanism 48 to provide gear ratio adjustments and/or geometric adjustments due to powertrain package constraints. The solenoid may receive a signal from controller 36 to engage the pinion gear once the electric machine is at a suitable speed for smooth torque transfer to start the engine.

When the engine is restarted, it may be restarted from an inactive state having substantially zero rotational speed, or from a speed which is significantly less than the rotational speed of the downstream powertrain components such as the first electric machine 20. The controller 36 may implement a delay following the initial restart of the engine 12 to allow engine speed to ramp up to be within a predetermined range of the system speed prior to closing the clutch 16. Reducing the difference between engine speed and speed of the downstream components improves the smoothness of the engagement of the clutch 16 and reduces NVH perceived by a passenger related to the engine restart event. However, a significant delay may lead to a perceivable lag in the delivery of additional propulsion torque required from the engine.

Some powertrain systems may include a brush contact type of starter motor coupled to the engine to provide the startup function. The starter motor is commonly powered by a low-voltage battery connected over a low-voltage bus. It may be powered by low-voltage battery 44 for example, or by a supplemental low-voltage power source. Conventional low-voltage batteries typically have a nominal voltage of about 12 volts and generally less than 18 volts. Low-voltage loads 46 such as vehicle accessories are also commonly powered over the low-voltage bus.

It may be undesirable to keep a brushed-contact starter motor connected to the power source on an ongoing basis. Therefore a brushed-contact starter motor systems may include a second solenoid to actuate a mechanical connection to an electrical terminal to provide power. Thus when it is desired to start the engine, the first solenoid and second solenoid must both be actuated. In many instances the actuation must be performed sequentially. For example, the second solenoid may be actuated to provide power to allow the starter motor to build up rotational speed. Then the first solenoid may be actuated to mechanically engage the starter motor output to the engine to facilitate the start event. Such a sequential actuation of multiple solenoids to operate the starter motor may contribute to an undesirable time delay for an engine restart.

In some cases when the engine is started, a temporary voltage drop is caused by the power load of the starter motor. A passenger may perceive certain symptoms such as reduced lamp illumination levels or temporary degraded function of other electrically-powered accessories due to the voltage drop. Power compensation means may be used to avoid such undesirable symptoms. For example an additional DC-DC boost converter may be provided to temporarily step up the voltage to mask potential symptoms related to a voltage drop caused by the starter motor. Alternatively, a second power source may be provided to supplement the battery and compensate for any voltage drop. Each of the above examples of a voltage drop compensation means may increase cost, weight, and complexity of the propulsion system.

The brush contact type of motor may also be inherently limited in the time required to start the engine. Related to the construction of the brush contact motor, windings affixed to the rotor increase both the size and the mass of the rotor. The additional rotational inertia of the rotor may cause a higher duration of time to reach a desired rotational speed from rest. This adds to the duration of the engine restart event and subsequently may limit the responsiveness of the propulsion system.

According to an aspect of the present disclosure, the second electric machine 40 is a brushless permanent magnet DC motor coupled to the engine 12 to provide a starting torque to restart the engine 12. In one example, the second electric machine 40 is powered by the high-voltage traction battery 22 over the high-voltage bus. The high-voltage operation of the second electric machine 40 provides rapid engine restarts that enable quick acceleration following engine deactivation during coasting for example.

Operating the second electric machine 40 over the high-voltage bus may eliminate the need for a boost converter to stabilize the voltage in the circuit due to power draw. The second electric machine is powered by the same power source as the traction motor, or first electric machine 20. Utilizing a single high-voltage power source also avoids the need for a supplemental power source to mitigate voltage drops caused by starter operation. Further, by powering the second electric machine over the separate high-voltage bus, electrical isolation may be achieved between the engine starting function and other vehicle accessory functions.

In other examples, the second electric machine 40 may be powered directly by the low-voltage power supply 44. For example a conventional propulsion system having a combustion engine and no high-voltage power source may still be within the scope of the present disclosure. More specifically, the propulsion system may be configured where each of the traction motor 20, the high-voltage battery 22, the power inverter 24, and the DC-DC-converter 42 are omitted. In such cases, engine start-stop features may operate with improved performance using the starter electric machine configurations described herein. The design of the brushless electric machine 40 when implemented as a starter is such that supplemental power boosting means may be eliminated even when powered over a low-voltage bus. For example considering 12-volt vehicle electrical systems, a brushed starter motor contributes to voltage sag while drawing current during engine cranking. As discussed above, a power boosting means such as an energy storing capacitor or a DC-DC voltage boost converter may be implemented to mitigate effects of the voltage sag. As discussed in more detail below, the brushless motor design of the present disclosure requires less initial current draw to begin operation of the rotor eliminating voltage sag during cranking, thus mitigating the need for supplemental power boosting.

Figure 2:
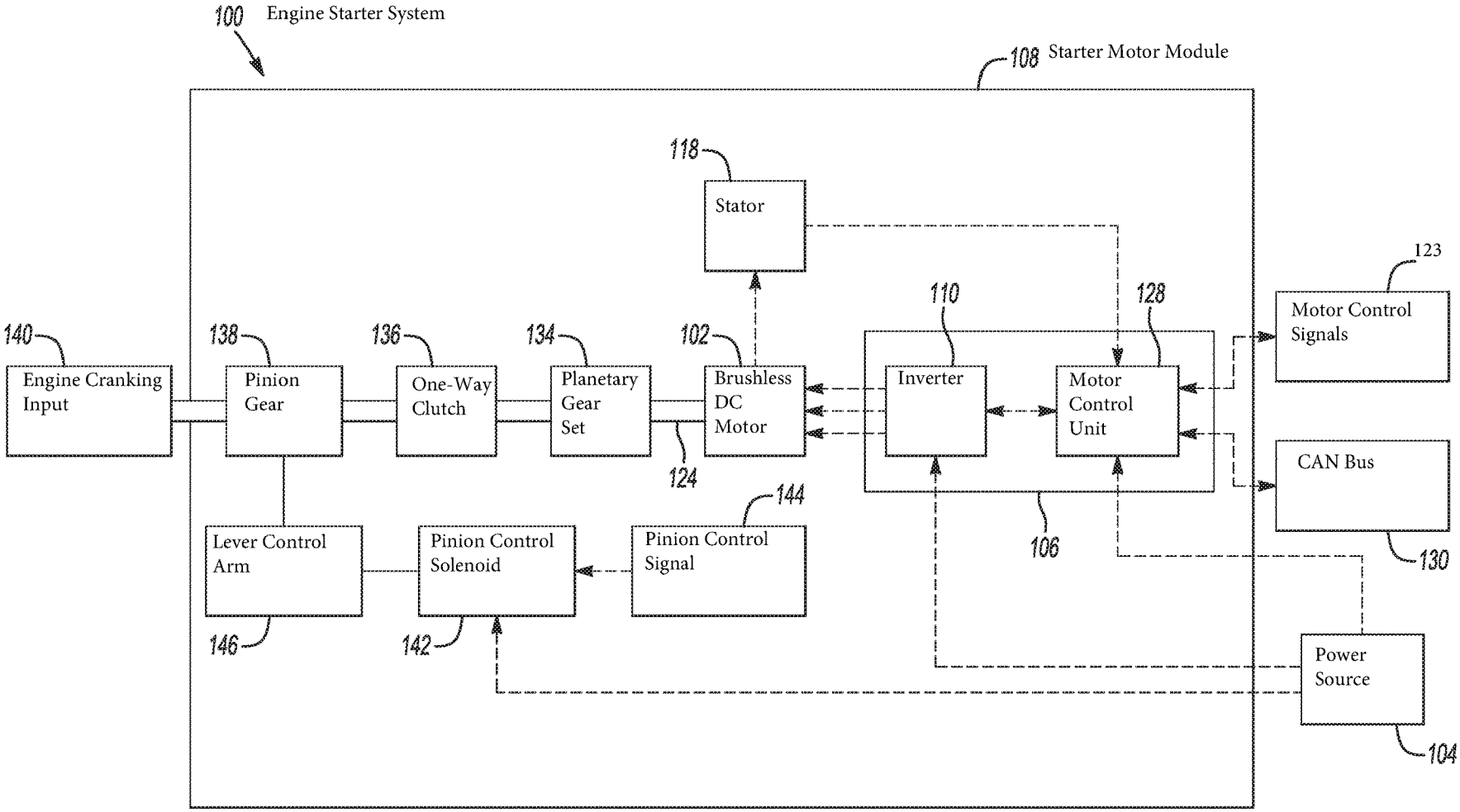
FIG. 2 is a system schematic of an engine starter system.
Figure 3:
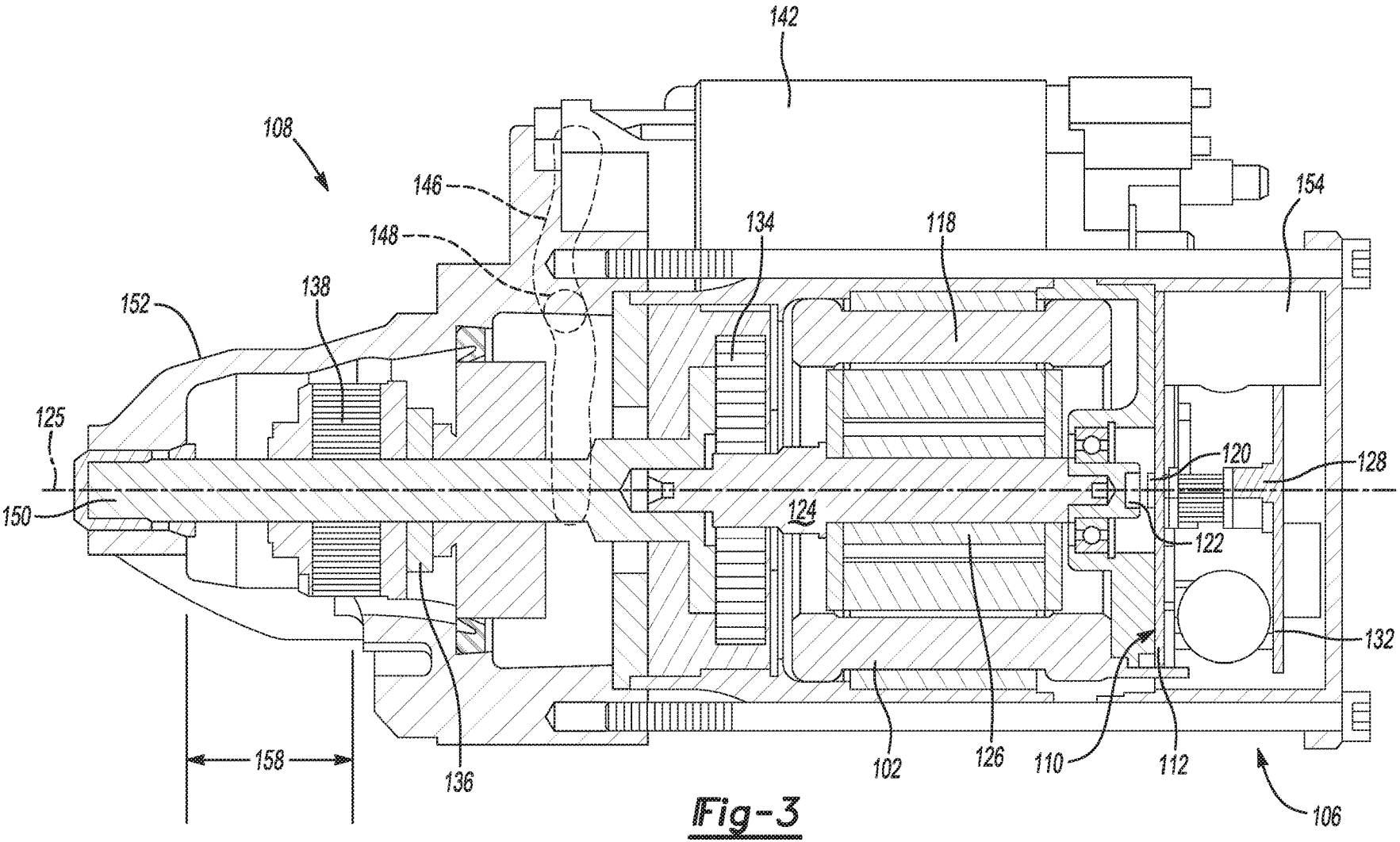
FIG. 3 is a cutaway view of a starter motor module.

Referring collectively to the FIG. 2 through FIG. 4, an engine starter system 100 is configured to provide engine cranking. A brushless DC motor 102 is provided to generate engine cranking torque. Power source 104 is in electrical connection with the motor 102 to provide DC current. As discussed above, the power source 104 may be configured to output power at any of a range of voltages to operate the starter. An electronic controller assembly 106 is disposed between the power source 104 and the motor 102 and includes components to condition the electric power provided from the power source. In some examples, the electronic controller 106 is integrated as part of a single unit starter motor module 108. While the controller is depicted as being coaxial relative to a center axis of rotation 125, one or more portions of controller 106 may be arranged to be off-axis relative to the center axis of rotation 125 of the motor. In other alternative examples, the electronics controller is configured to be separate from the starter motor module as a standalone controller or may be part of an overall engine control unit (ECU) controller and provide remote signals to operate the starter.

Figure 4A:
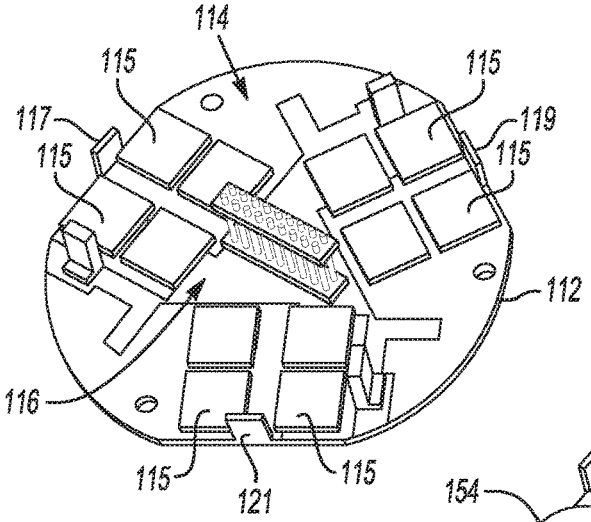
FIG. 4A through FIG. 4C are partial views of a controller electronics assembly.
Figure 4B:
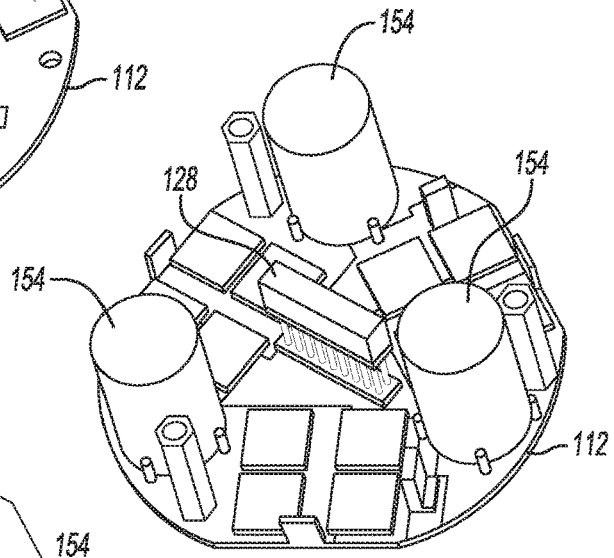
Figure 4C:
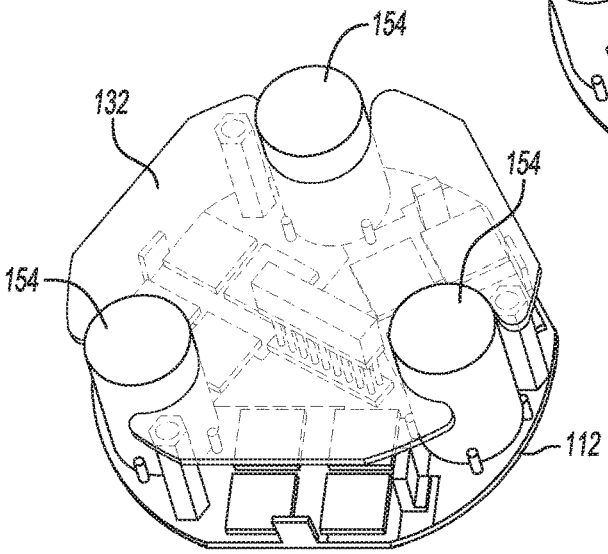
Figure 4D:
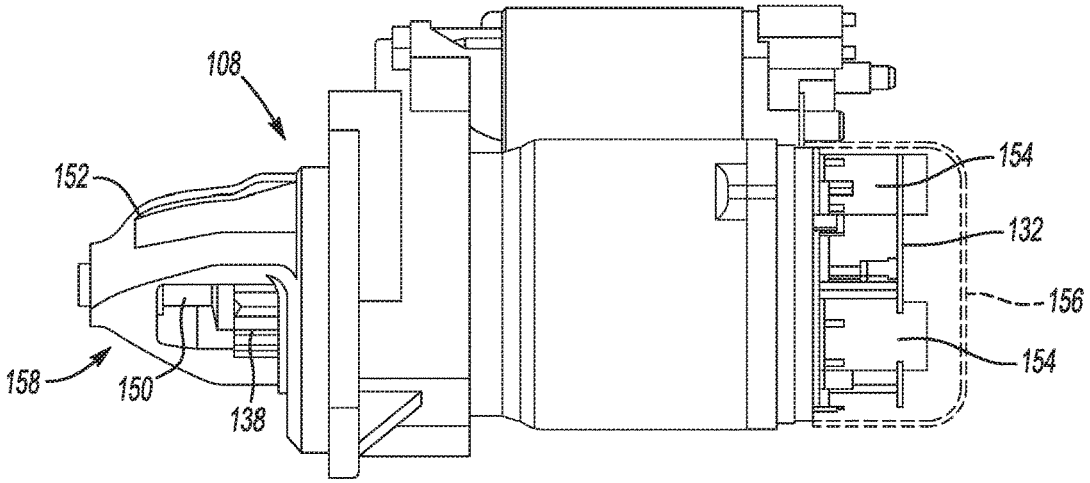
FIG. 4D is a perspective view of the starter motor module of FIG. 3.

The electronic controller assembly 106 includes a power management portion having an inverter 110 to convert direct current into three phase alternating current to drive the brushless motor 102. The inverter 110 may be integrated as part of a printed circuit board (PCB) 112 provided to manage a power portion of the electronic assembly 106. Referring to FIG. 4A through FIG. 4C, a first region 114 of the PCB 112 is connected to an electrical ground. A conducting second region 116 of the PCB 112 may be connected to the power source. Six pairs of silicon microchips 115 are mounted to the second region 116. Each of the pairs of microchips 115 functions as a switch to selectively transmit power to windings of the stator 118 to drive the brushless motor 102. In the examples of FIG. 4A through FIG. 4C, the microchip switches 115 are MOSFET devices arranged in parallel. Also, the power switches 115 can be formed using single or plurality of paralleled MOSFETs, GaN FETs, SiC FETs, IGBTs or other type of semiconductor switches.

The PCB structure may comprise an FR4 multi-layer board having suitable thickness copper interlayers. In other alternate examples, the power management portion may include a power module assembly instead of a PCB where microchips are directly mounted to a direct bonded copper (DBC) substrate. A sheet of copper or aluminum may be bonded to one or both sides of an insulated substrate (e.g. alumina or silicon nitride) with copper traces. The sheet can be pre-formed prior to firing or chemically etched using printed circuit board technology to form an electrical circuit, while a bottom sheet may be kept plain. In a further examples, microchips may be connected to copper bus bars or on lead frame also having isolation conducive to electrical switching. Generally, a power management portion includes a plurality of switches configured to manage power from the power source and apply pulse width modulation (PWM) as discussed in more detail below. These switches can be packaged with leads ready for assembly on the PCB or may be formed "in die" and mounted on a copper lead frame and wire-bonded to make the necessary electrical connections. The PCB 112 is connected to the brushless motor 102 to pass three-phase alternating current through electrical terminals 117, 119, and 121.

The brushless motor 102 may also include one or more position sensors 120 to detect the movement and position of the rotor. In some examples, the position sensor 120 is a Hall effect sensor disposed on the PCB 112 and arranged to pick up the presence of one or more position magnets 122 disposed on a portion of an output shaft 124 the rotor 126. The position magnet 122 may be located to be concentric to the axis of rotation 125 of the motor output shaft 124. The magnetic field of the position magnet 122 rotates along with the rotor 126 (and output shaft 124) thus changing polarity direction and thereby providing input to the position sensor 120 indicative of movement of the rotor 126. The position sensor 120 is arranged at a predetermined spacing from the magnet based on the type of magnet and the strength of the magnetic field.

The electronic controller assembly 106 also includes at least one processor such as motor control unit 128 (MCU), which includes gate drivers to accept low-power motor control signals 123 from an external controller regarding activation of the motor 102. The MCU 128 also regulates high-current drive inputs from the power source 104 to operate the gates of the high-power inverter 110. The MCU 128 is in communication with the power source 104 and may receive signals indicative of performance of the power source, such as battery state of charge, voltage feedback, current feedback or other parameters. The MCU 128 may further be in communication with other vehicle controllers via the vehicle CAN bus 130. As described above one or more propulsion system controllers may regulate the timing of engine restarts and transmit command signals to the MCU 128. And, MCU 128 may transmit back signals indicative of the timing of an engine restart to be used as an input to other functions of the propulsion system such as transmission shift scheduling, hybrid vehicle propulsion mode selection, and power regeneration for example. According to aspects of the present disclosure a starter motor controller is programmed to transmit signals indicative of the imminent onset of engine propulsion torque.

In some examples the MCU 128 is a processor disposed on a control board 132 that is spaced from the power management portion. The MCU 128 may include a digital signal processor (DSP) microcontroller or an application-specific integrated circuit (ASIC) for example. The spacing between the control portion and the power portion is arranged to assist with thermal management of the control board 132 by allowing heat generated from the power management portion to sufficiently dissipate without affecting the operation of the MCU 128. Also, the spacing reduces interference at the MCU 128 related to electrical noise generated by the high speed switches. Signals indicative of the starter system operation are transmitted to the control board 132. And, commands are sent back from the MCU 128 to switches of the inverter. Operation of the inverter switches may be based on any combination of rotor position, temperature, motor feedback current, battery feedback current, battery voltage, ECU signals, or other parameters.

The power management portion may also include one or more capacitors 154 which operate as filters to smooth the PWM current output from the switches. In the examples of FIG. 3, FIG. 4 and FIG. 6, capacitors are connected to the power portion PCB and enclosed within a sealed electronics housing 156. The capacitors 154 of FIG. 4 may be arranged according to heat dissipation of the power management portion of the electronics assembly. The capacitors 154 are oriented to extend generally normal from the PCB 112. The may be cutout portions provided in the control board 132 to allow clearance for the upright capacitors 154. In some alternate examples, power filtering portions of the electronics may be located external to the electronics housing 156 in a separate housing. The location of the power filter portions may also be configured to be electrically upstream relative to the power inlet (e.g., attached to an outer portion of the control board 132).

Torque output through the motor output shaft 124 of the brushless motor 102 is transmitted to a gear reduction mechanism to amplify the torque to crank the engine. In some examples, a planetary gear set 134 receives torque from the brushless motor 102 and outputs an increased torque at a reduced speed. In some examples the reduction ratio may be from about 25:1 to about 55:1.

Torque transferred by the planetary gear set 134 is passed through a one-way clutch 136. The one-way clutch 136 is configured to lockup and pass torque in a first cranking direction, and allow rotational slip in a second reversal direction. In this way, negative torque is not returned to the motor 102. Additionally, engine overrun conditions may be absorbed at the one-way clutch 136 to compensate for speed undulations and allow engine speed to exceed starter motor speed without penalty while the starter motor is engaged.

The output torque of the starter motor module 108 is transferred to an engine cranking input 140 through a pinion gear 138. In some examples the pinion gear 138 engages a crankshaft of the engine directly to activate the engine. In other examples the pinion gear 138 is arranged to engage a flywheel, belt drive, or chain drive which is coupled to the crankshaft of the engine.

The pinion gear 138 is further arranged to translate and index between a first disengaged position and a second engaged position. An electrically activated pinion control solenoid 142 causes the pinion to change positions with solenoid is energized. A pinion control signal 144 may be provided to cause the solenoid 142 to be energized. In some examples, the pinion control signal 144 is generated at the electronic controller assembly 106 and is coordinated with the motor operation signals 112. In alternate examples, the pinion control signal 144 may be provided by a propulsion system controller external to the starter motor module 108. A pinon lever control arm 146 is disposed between the pinion control solenoid 142 and the pinion gear 138. Energizing the solenoid 142 actuates a first end of the lever control arm 146, which pivots about a fixed portion 148. An opposing end of the lever control arm 146 moves the pinion gear 138 to the second engaged position. In one example the pinion gear 138 is arranged to slide along a shaft extension 150 to index between the first disengaged position and the second engaged position. A housing 152 about the gearing portion includes an opening 158 which allows the pinion gear 138 to engage the engine cranking input portion 140 to provide cranking torque.

Figure 5:
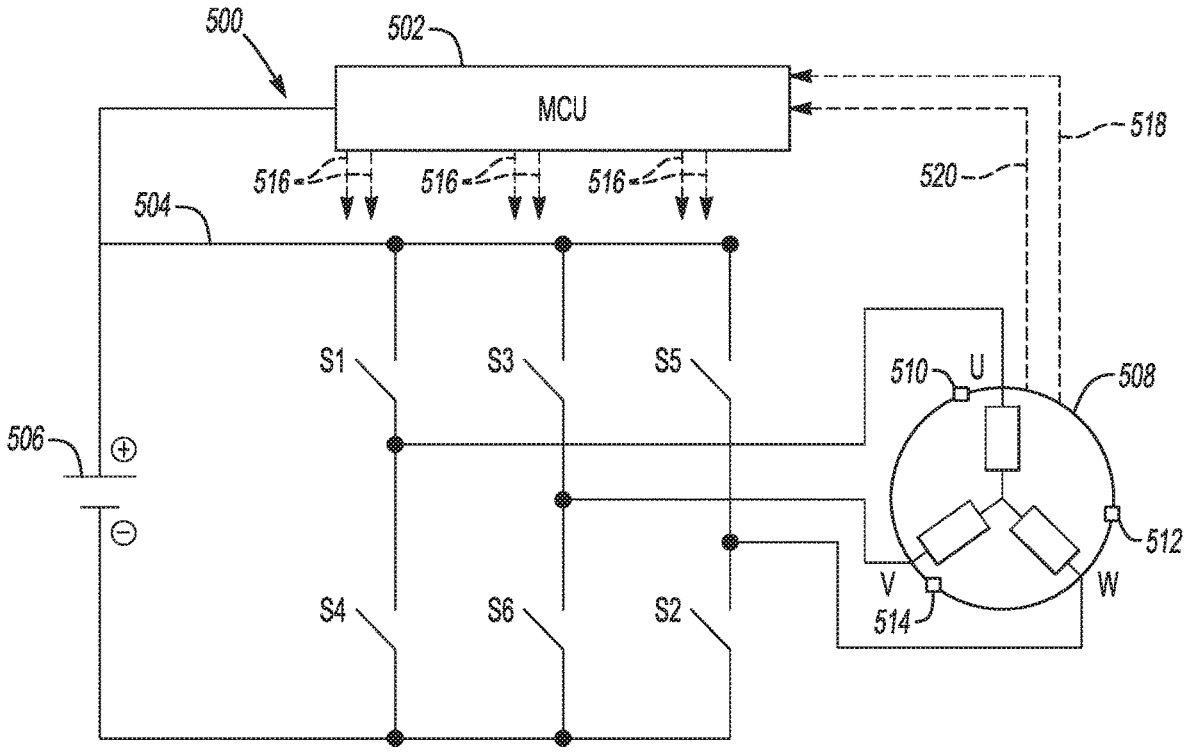
FIG. 5 is a partial circuit diagram of a switch set and driver for an electric machine.
Figure 6A:
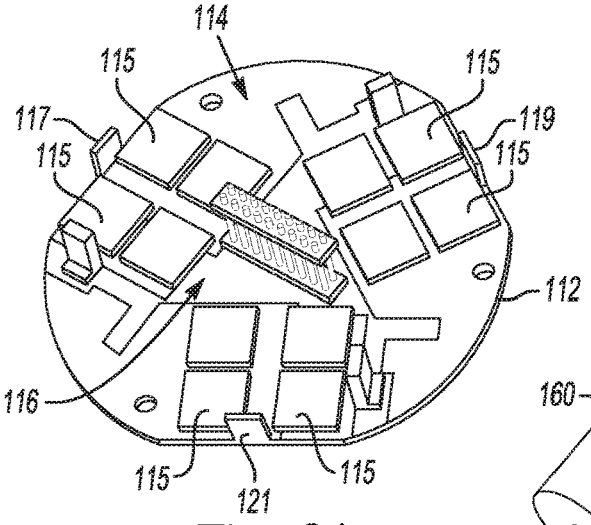
FIG. 6A through FIG. 6C are partial views of an alternate embodiment controller electronics assembly.
Figure 6B:
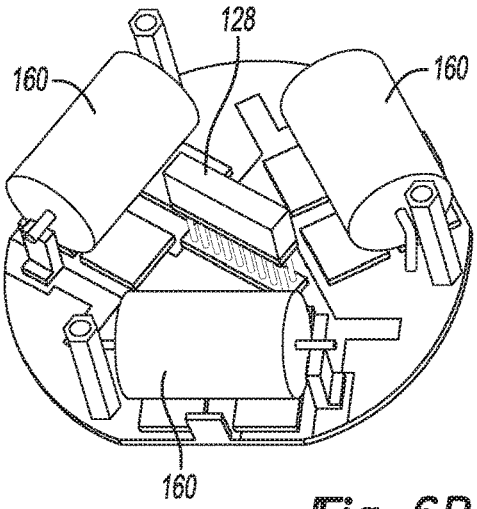
Figure 6C:
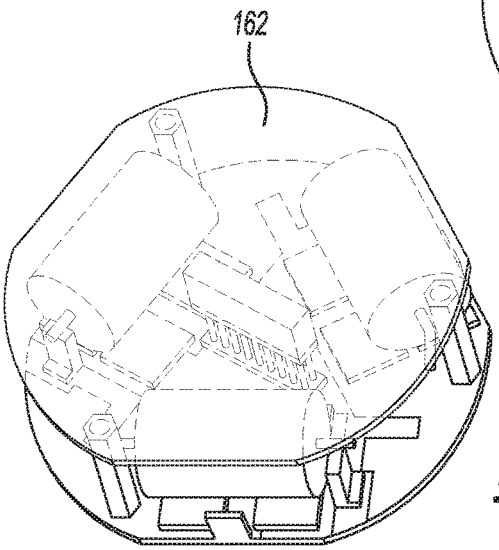
Figure 6D:
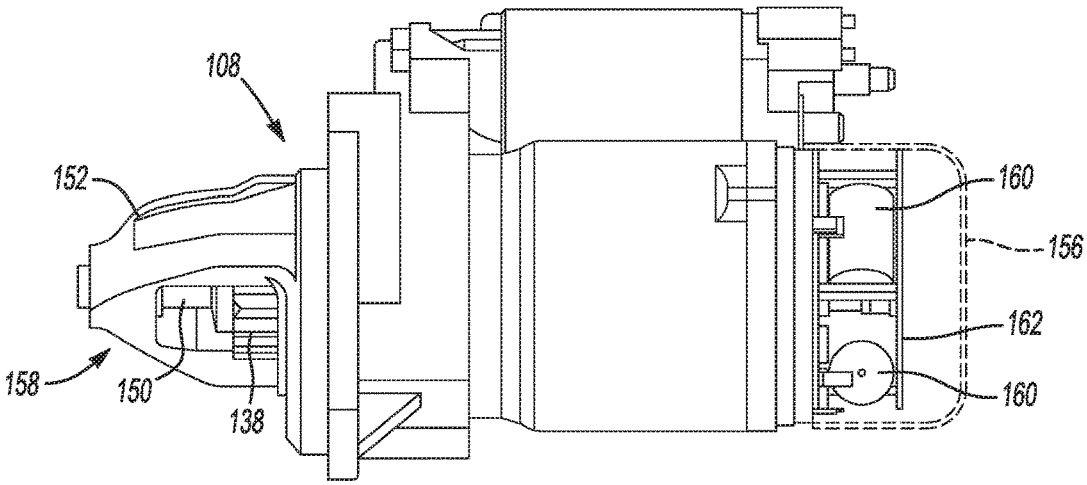
FIG. 6D is a perspective view of an alternate embodiment starter motor module.

Referring to FIG. 5, control circuit 500 depicts an example schematic of an electronic controller assembly used to operate a starter electric machine. As discussed above, the control circuit may be integrated as part of a starter electric machine module. An MCU 502 is programmed to communicate with one or more controllers of the vehicle. The MCU 502 also stores one or more operation algorithms to operate the electric machine. A power stage portion 504 includes a plurality of solid-state switches (e.g., MOSFET, IGBT type transistors) which function as logic gates. In the example of FIG. 5, six power switches (S1 trough S6) are independently and selectively connectable to a DC power source 506. As discussed above, the power source may be configured to be either high-voltage or low-voltage depending on the vehicle application. The MCU 502 provides gate signals to each of the switches to close the switches at a predetermined timing. When closed, a given switch passes current to one or more connections at motor 508. As discussed above, the power switches S1 through S6 can be formed using single or plurality of paralleled MOSFETs, GaN FETs, SiC FETs, IGBTs or other semiconductor switches.

Operation of the control circuit provides electronic commutation and converts DC current from the power source 506 into alternating current to drive the motor. While a three-phase configuration is presented herein by way of example, it is contemplated that other multi-phase configurations may be suitable for motor control. For example, multiple devices may be provided per switch per phase and be arranged to create five, six, seven or more phases. Multiple stages of a commutation sequence are achieved by activating the switches S1-S6 in a sequence to create a rotating magnetic field within the electric machine 508. Based on selection of particular switches and the rate of actuation, the speed and the output torque of the electric machine 508 may be precisely controlled. In this way, a separate inverter outside of a starter motor module is not required to convert the direct current from the power source into multi-phase alternating current to drive the electric machine 508. Thus DC power may be provided directly to the starter motor without preconditioning.

The electric machine 508 also includes one or more position sensors (e.g., Hall-effect sensors) to output signals indicative of the position and speed of a rotor of the electric machine 508. In the example of FIG. 5, three Hall-effect sensors, HA 510, HB 512, and HC 514 are disposed on a stator portion of the electric machine 508 to detect position and movement of one or more magnets disposed on the rotor. The sensors 510, 512, and 514 may be evenly spaced to be about 120 degrees apart in angle around the stator. In other examples and as described above, a single position sensor magnet is disposed on the rotor output shaft and rotates with the rotor. And, a single sensor may be spaced a predetermined distance from the magnet to sense rotation of the sensor magnet about a central axis of the electric machine. Position feedback from the sensors may be used as input to the control logic stored at the MCU 502 to influence the actuation of the solid-state switches. The control logic may also include protection against undesirable motor conditions such as overcurrent, short-circuit, and thermal overheating. The integrated control circuit 500 may also include instructions to execute a control action in response to detection of one or more error conditions of the electric machine.

The electric machine control strategy may utilize field-oriented control to achieve maximum torque per ampere and an extended range for output speed. The output speed and position of the rotor shaft may be determined based on rotor position feedback signal 518 and serve as a feedback input into the control strategy. In addition to using position data, a current feedback signal 520 provides a current loop used to control the electromagnetic torque produced by the machine. Advantages of field-oriented control include accurate speed control, good torque response, and full torque at near zero speed. Each of a plurality of feedback signals are used to adjust switch control signals 516 to open or close each of switches S1 through S6 as appropriate to drive the motor 508.

Referring to FIG. 6, an alternate configuration of the power supply portion is provided where capacitors 160 are oriented to be generally planar and located between the PCB 112 and a control board 162. The alternate configuration of the capacitors 160 is such that they are packaged closer to the power supply portion to provide a more efficient package. Additionally, more area is available on the control board 162 to layout control circuitry due to reducing the need for cutouts of the previous configuration having capacitors oriented normal with respect to the PCB 112. In this was more flexibility is afforded with respect to circuitry layout of the control board 162.

Figure 7:
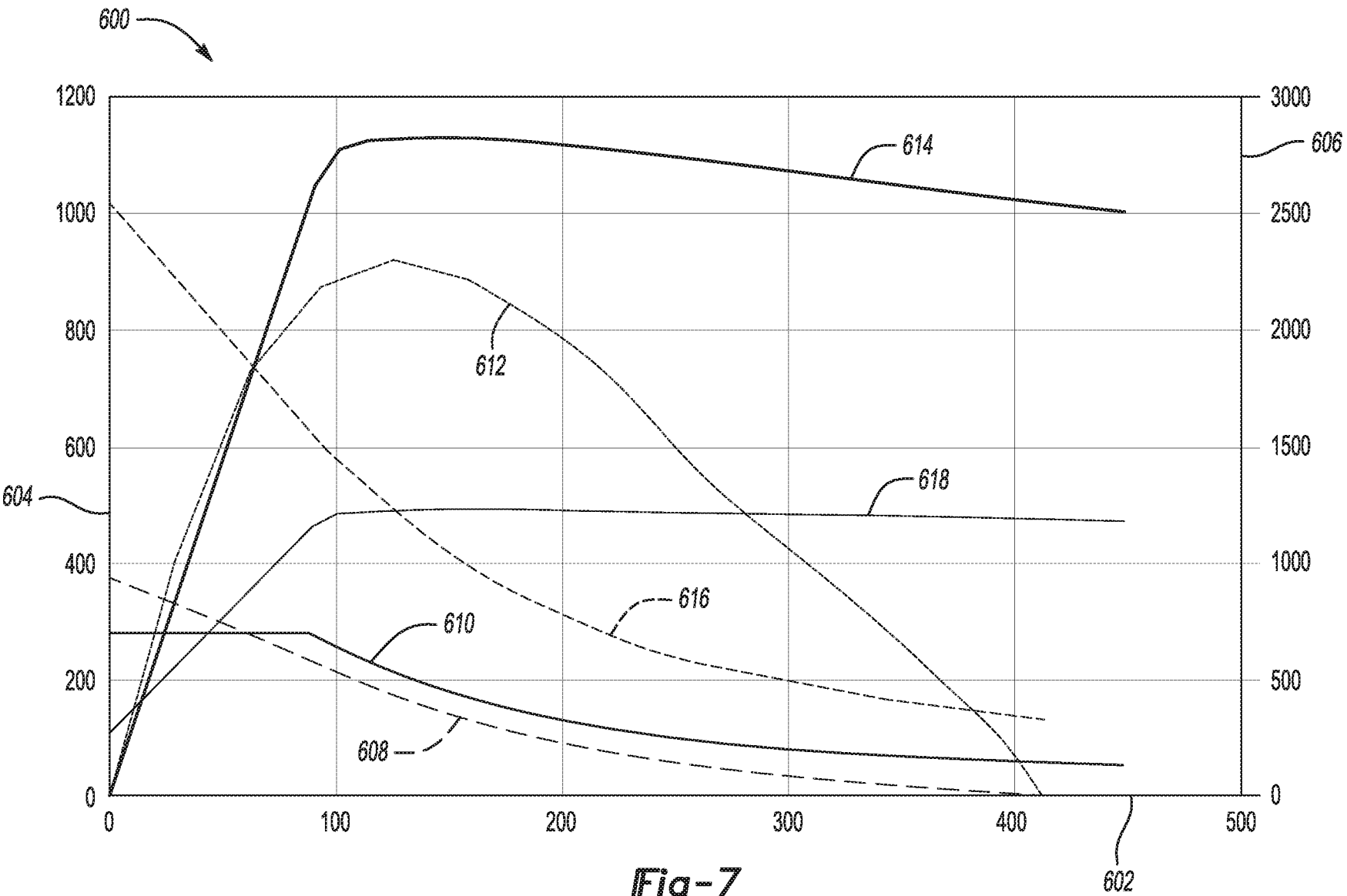
FIG. 7 is a plot of electric machine output.

Referring to FIG. 7, plot 600 depicts performance of a pair of electric machines according to additional aspects of the present disclosure. The plots correspond to electric machine performance as measured at a shaft of the engine downstream of gear reduction mechanisms disposed between the engine shaft and the starter electric machine shaft. In the present example the output speed of the starter motor is reduced to amplify the torque applied to crank the engine. In some examples the reduction ratio is from about 40:1 to about 50:1. Horizontal axis 602 represents rotational speed of the engine shaft in RPM and current draw in Amps. The left side vertical axis 604 represents the cranking torque input into the engine by the electric machine in N-m. The right side vertical axis 506 represents the power applied to the engine in Watts. Each of torque and power input to the engine are plotted for both a brushed motor and a novel brushless motor according to certain parameters discussed above. Curve 608 represents a torque profile input to the engine by a conventional brushed starter motor. Curve 610 represents torque profile input to the engine from a brushless electric machine. It may be seen by comparison that aspects of the present disclosure provide a wider range of relatively constant output torque. As discussed above, it may be seen the novel brushless design according to aspects of the present disclosure applies a wider speed range of relatively constant torque to the engine. For example, between engine speed of about 0 and 100 RPM, the brushless motor configuration is capable of causing a relatively constant torque of about 280 N-m at the engine.

Power applied to the engine is also significantly improved according to aspects of the present disclosure. Curve 612 represents a cranking power profile applied to the engine by a brushed motor and curve 614 represents a cranking power profile applied to the engine by a brushless electric machine according to the present disclosure. It may be seen by a comparison between curves 612 and 614 that the brushless electric machine configuration causes higher cranking power levels to be applied to the engine, for example around 2,800 Watts. Additionally, the power applied by the brushed electric motor falls off to zero at about 400 RPM of the engine, while relatively constant power is still present at the engine from the brushless electric machine at significantly higher speeds. For example the brushless electric machine is capable of applying around 2,500 Watts to the engine when the engine shaft rotation speed is as high as 450 RPM.

Current draw of the brushless configuration is also significantly improved relative to brushed starter motor configurations. In the example plot 600 of FIG. 7, a brushless electric machine is powered by a low-voltage power source, at about 7.5 Volts. Although "nominal" low voltage may correspond to about 12 volts, lower voltage conditions may be present during severe conditions such as cold temperatures. Even in the lower voltage example application, the current drawn by the brushless electric machine configuration is significantly lower than brushed starter motor arrangements. Particularly during initial turns of the engine less than about 100 RPM, the initial current draw 616 of the brushed configuration is about 1,000 Amps and drops off as motor output tails off with increased speed. Comparatively, the initial current draw 618 of the brushless configuration according to the present disclosure is about 100 Amps, increasing to a maximum draw of about 500 Amps while applying more power even at higher engine speeds. The improved current draw performance reduces any voltage dip across the vehicle power bus during cranking eliminating the need for supplemental power boosting during cranking as discussed above.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A vehicle propulsion system comprising:

an engine configured to be selectively activated to provide torque to propel a vehicle; and a starter module coupled to the engine and configured to start the engine from an inactive state, the starter module including a brushless electric machine to generate an output torque to crank start the engine, a pinion gear coupled to the brushless electric machine, the pinion gear being actuatable to selectively engage a cranking input of the engine, a controller assembly programmed to cause actuation of the pinion gear to engage the cranking input of the engine and transfer a cranking torque to activate the engine, the controller assembly coaxial with an axis of rotation of the brushless electric machine, wherein the controller assembly is further programmed to translate the pinion gear along the axis of rotation of the brushless electric machine to a first engaged position in contact with the cranking input of the engine, and an integrated housing containing the brushless electric machine, the pinion gear, and the controller assembly.

2. The vehicle propulsion system of claim 1 wherein the controller assembly includes a power inverter to convert direct current from a power supply into multi-phase alternating current to drive the brushless electric machine.

3. The vehicle propulsion system of claim 2 wherein the multi-phase alternating current is from three phase alternating current to seven phase alternating current.

4. The vehicle propulsion system of claim 2 wherein controller assembly is further programmed to adjust the multi-phase alternating current based on at least one of a rotor position feedback signal and a current draw feedback signal from the brushless electric machine.

5. The vehicle propulsion system of claim 1 wherein the controller assembly includes a position sensor to detect at least one of a rotational speed and an angular position of the brushless electric machine.

6. The vehicle propulsion system of claim 5 wherein the position sensor is spaced a predetermined distance from at least one position magnet.

7. The vehicle propulsion system of claim 6 wherein the at least one position magnet comprises a single magnet affixed to a first end of an electric machine output shaft concentric to an axis of rotation of the brushless electric machine.

8. The vehicle propulsion system of claim 1 wherein the controller assembly is powered by a low-voltage power source.

9. The vehicle propulsion system of claim 1, wherein the brushless electric machine includes a stator having a plurality of windings in electrical connection to a power supply, a rotor disposed in a center bore portion of the stator, the rotor having a plurality of permanent magnets that are driven to rotate in response to power supplied to the plurality of windings, and an output shaft extending from a center portion of the rotor, the output shaft selectively coupled to an engine cranking input; and wherein the controller assembly is configured to store instructions to pass current from the power supply to the plurality of windings as multi-phase alternating current to drive the rotor.

10. The vehicle propulsion system of claim 9 further comprising a position magnet disposed near a first end of the output shaft, and a position sensor disposed on the controller assembly at a predetermined spacing from the first end of the output shaft, the position sensor being configured to output a signal indicative of at least one of rotation speed and angular position of the output shaft.

11. The vehicle propulsion system of claim 1 wherein the controller assembly includes a power inverter configured to convert direct current from a power supply into multi-phase alternating current to drive the brushless electric machine, and the controller assembly is further programmed to receive an engine start command from a vehicle controller, in response to the engine start command, operate a plurality of switches in connection with the power supply using pulse width modulation (PWM) to generate the multi-phase alternating current, and adjust operation of the plurality of switches based on at least one of a rotor position feedback signal and a current draw feedback signal from the brushless electric machine.

12. The vehicle propulsion system of claim 11 wherein the power supply comprises a low-voltage power supply.

13. The vehicle propulsion system of claim 1 wherein the controller assembly includes a position sensor configured to sense at least one of a rotor rotational speed and a rotor angular position based on detection of at least one position magnet disposed on a rotor of the brushless electric machine.

14. A vehicle propulsion system comprising:

an engine configured to be selectively activated to provide torque to propel a vehicle; and a starter module coupled to the engine and configured to start the engine from an inactive state, the starter module including a brushless electric machine to generate an output torque to crank start the engine, a pinion gear coupled to the brushless electric machine, the pinion gear being actuatable to selectively engage a cranking input of the engine, a controller assembly programmed to cause actuation of the pinion gear to engage the cranking input of the engine and transfer a cranking torque to activate the engine, the controller assembly coaxial with an axis of rotation of the brushless electric machine, wherein the controller assembly is further programmed to translate the pinion gear along the axis of rotation of the brushless electric machine to a first engaged position in contact with the cranking input of the engine, and an integrated housing containing the brushless electric machine, the pinion gear, and the controller assembly, wherein the controller assembly includes a power management portion having a plurality of switches in connection with a power supply and being arranged to provide pulse width modulation to generate multi-phase alternating current;

wherein the plurality of switches comprise at least one of MOSFET, GaN FET, SiC FET, and IGBT type of semiconductor switches;

wherein the controller assembly includes a motor control unit (MCU) spaced from the power management portion, the MCU programmed to activate each of the plurality of switches in response to an engine cranking command; and wherein the MCU is further programmed to activate the plurality of switches based on at least one of a rotor position feedback signal and a current draw feedback signal.

* * * * *